United States Patent [19]

Geppelt et al.

[11] 4,437,329

[45] Mar. 20, 1984

[54] METHOD OF MANUFACTURING TWISTED TUBES

[75] Inventors: Elmo W. Geppelt; William H. Poore, both of Tulsa, Okla.

[73] Assignee: Delta Limited, Tulsa, Okla.

[21] Appl. No.: 295,143

[22] Filed: Aug. 21, 1981

[51] Int. Cl.[3] ..... B21D 7/00; B21D 11/14

[52] U.S. Cl. ..... 72/299; 72/342; 72/371

[58] Field of Search ..... 72/299, 371, 342, 64

[56] References Cited

U.S. PATENT DOCUMENTS

| | | | |
|---|---|---|---|
| 825,511 | 7/1906 | Blondell | 72/299 |
| 1,095,324 | 5/1914 | Hall | 72/299 |
| 2,667,852 | 2/1954 | Brown, Jr. | 72/342 |
| 2,881,822 | 4/1959 | Henry | 72/371 |
| 3,117,471 | 1/1964 | O'Connell et al. | 72/299 |
| 3,198,926 | 8/1965 | Melmoth | 72/342 |
| 3,198,928 | 8/1965 | Allison | 72/342 |
| 3,533,267 | 10/1970 | Bunnell | 72/299 |
| 4,188,813 | 2/1980 | Bournicon et al. | 72/299 |

FOREIGN PATENT DOCUMENTS

| | | | |
|---|---|---|---|
| 700879 | 12/1964 | Canada | 72/299 |

*Primary Examiner*—Daniel C. Crane

*Attorney, Agent, or Firm*—Head, Johnson & Stevenson

[57] ABSTRACT

A method of manufacturing a spiral tube including the steps of positioning an elongated mandrel within a tube, grasping the ends of the tube, forming a point of reduced resistance to torsional force in the wall of the tube, rotating one end of the tube while the other end is held stationary to cause the formation of a spiral groove in the tube, the mandrel defining the minimum interior diameter of the spiral tube so formed, and advancing the means grasping the tube towards each other to compensate for the reduction of length of the tube as the spiral groove therein is formed, and maintaining at least the area of the tube at which the spiral groove is being formed at an elevated temperature.

3 Claims, 3 Drawing Figures

METHOD OF MANUFACTURING TWISTED TUBES

BACKGROUND OF THE INVENTION

1. Field of the Invention

This invention relates to an improved method of manufacturing spiral tubes. Spiral tubes are normally used for applications in which a gas or fluid medium is circulated through the tubes and a gas or fluid medium circulated exterior of the tubes so as to exchange heat between the medium interiorly and the medium exteriorly of the tubes. Methods have been devised for manufacturing such spiraled tubes. However, the present methods are commercially applicable to tubes formed of a material such as aluminum or copper which is easily deformed by twisting to form a spiral. The present invention is directed towards an improved means of forming a spiral tube wherein the material of which the tube is formed is of a relatively harder, more brittle, and less ductile material.

2. Description of the Prior Art

For information relating to the method of manufacturing spiral tubes, reference may be had to previously issued U.S. Pat. Nos. 3,015,355; 3,533,267; and Re. 24,783. These prior issued U.S. patents show the concepts of forming spiral tubes of easily deformable, ductile material, such as aluminum, copper, and the like. The basic concept of manufacturing such spiral tubes such as set forth in Re. Pat. 24,783, has been improved as reflected in copending United States Pat. application No. 106,950, now Pat. No. 4,317,353, entitled: "TUBE TWISTING APPARATUS", and filed Dec. 26, 1979, by Elmo W. Geppelt et al.

These prior art devices work satisfactorily to produce spiral tubes; but when a tube is required to be of relatively hard, less ductile material, attempts to form spiral tubes utilizing the known technology have not been successful. When tubes must be formed of material capable of withstanding high temperatures, such as titanium, stainless steel and the like, particularly when the tube walls are relatively thick compared to tube diameters, the formation of a spiral groove by twisting a tube has not been successful. Instead of forming a spiral groove as the tube is twisted, the tubes have a tendency merely to twist in two. From experimentation it appears that a certain amount of ductility is required in order to extend a spiral throughout the required length of a tube by twisting the tube. When such ductility is not available in the material being used, the successful manufacture of spiral tubing utilizing the known prior art has not been commercially accomplished.

It is an object of this invention to provide an improved means of manufacturing spiral tubing of relatively nonductile material which overcomes the problems and limitations of the prior art.

SUMMARY OF THE INVENTION

A method of manufacturing a spiral tube of a relatively nonductile material is provided by this invention. First, an elongated cylindrical mandrel is positioned within the tube. The tube is then grasped adjacent each end and a mechanism, similar to a lathe, providing means of selectively twisting the tube which is accomplished by rotating one end of the tube while the other is in held in a nonrotated position. Before the twisting operation is initiated, there is formed a point or points of reduced resistance to torsional force, such as one or more dimples in the wall of the tube. The step of imparting the dimple or dimples in the tube may be accomplished before the mandrel is placed therein and before the tube is inserted into the machine or after these steps are accomplished, depending upon the particular manufacturing process employed. After the tube is supported about a mandrel at its end and a dimple or dimples formed therein, the tube is ready to have the formation of the spiral groove therein imparted by rotating one end of the tube relative to the other. In order to achieve successful propagation of the spiral groove, this invention includes the step of heating the tube in the area therein at which the groove is being formed to an elevated temperature above ambient and below the melting point of the material of which the tube is formed, the temperature range being selected to raise the ductility of the material of which the tube is formed at the point wherein the groove or grooves are being imparted so as to permit the formation of the groove or grooves without destruction of the tube as it is rotated. This heating can be accomplished such as by heating the tube prior to initiation of the spiraling action which can be accomplished before the tube is inserted into the machine which accomplishes the rotation of one end relative to the other or can be accomplished after the tube is positioned in the machine. A preferred arrangement, however, employs a heating means applied to the tube in the area of and immediately preceding that wherein the spiral groove or grooves are being formed. This heating means may be accomplished by inductive heating using electrical energy or by the use of a gas flame. The preferred arrangement includes means of advancing the heating means along and in advance of the formation of the groove or grooves as the tube is being twisted.

DESCRIPTION OF THE VIEWS

FIG. 1 is a diagrammatic view of an apparatus which may be employed to practice this invention. The apparatus is in the nature of a lathe having a headstock and a nonrotating tailstock and includes means of attaching a tube therebetween and means of imparting rotary motion to one end of the tube relative to the other and illustrating a preferred means of imparting heat to the tube in the area thereof wherein the groove is being progressively formed.

DETAILED DESCRIPTION

Figure 1:
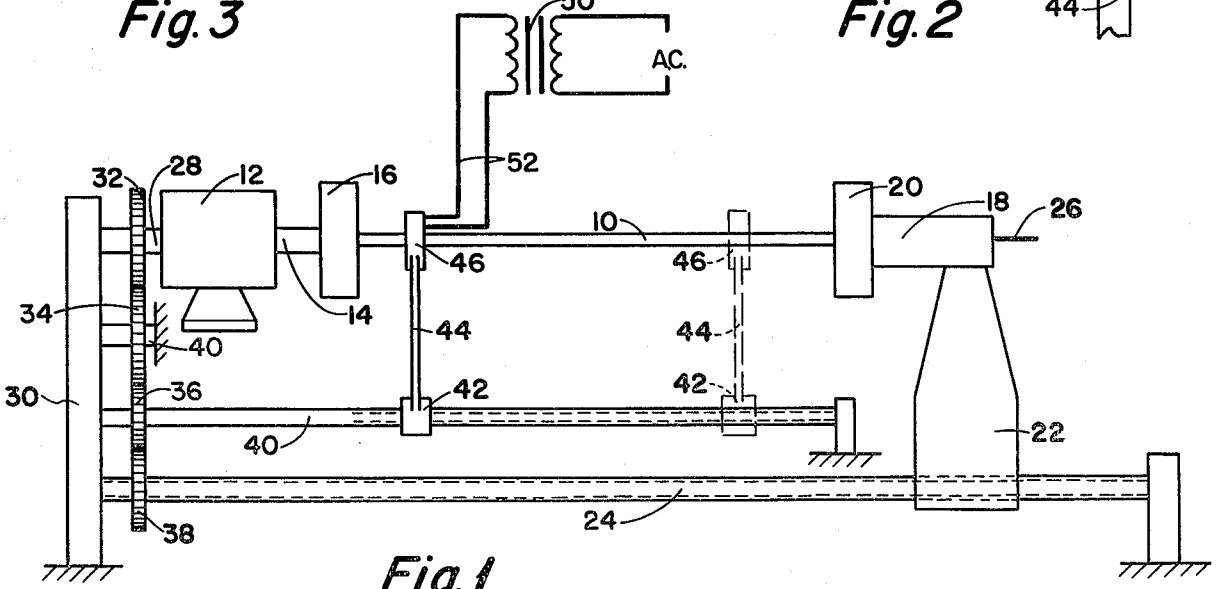

Referring to the drawings and first to FIG. 1, a preferred method of manufacturing a spiral tube according to this invention is shown diagrammatically. For more detailed information as to the apparatus and techniques for manufacturing a spiral tube, reference may be had to the above-mentioned copending application which is incorporated herein by reference. A tube to which a spiral is to be imparted is indicated by the numeral 10. The tube is shown supported within a lathe-like apparatus which includes a motor 12 having a shaft 14 connected to a headstock or collet-type device 16. The headstock 16 has means for grasping one end of tube 10. Spaced from headstock 16 is a tailstock member 18 having a collet portion 20. The tailstock 18 is supported by a base portion 22 which is positioned by a lead screw 24.

The tailstock collet 20 has means for grasping one end of the tube 10 and for holding it in a nonrotating condition. The tailstock 18 and collet portion 20 are hollow so as to receive a mandrel 26 which extends within tube 10 to the full length thereof wherein a helical groove is to be imparted in the tube. The diameter of mandrel 26 is selected so as to establish the minimum diameter of the tube as a groove is spiraled in it.

Motor 12 has a second shaft 28 extending from the end thereof of opposite shaft 14, the shaft 28 extending to a bearing block 30. Received on the shaft 28 is a gear 32 which drives idler gear 34 which in turn drives a heating element positioning gear 36 and that in turn drives a tailstock positioning gear 38. Idler gear 34 is supported about a fixed shaft 40. The tailstock positioning gear 38 is affixed to lead screw 24 so that when motor 12 is energized to impart a rotational motion to tube 10, rotary motion is applied to lead screw 24 to move the tailstock 20. The amount of displacement of tailstock 18 is selected to compensate for the shortening of tube 10 caused by imparting a spiral groove therein. This is arranged by means of the gear ratios and the pitch of lead screw 24. In some manufacturing techniques the tailstock 18 is merely supported in a slidable but nonrotatable position so that the shortening of the tube 10 controls the linear positioning of the tailstock; however, in the preferred arrangement which ensures more accurate manufacturing tolerances, the tailstock is positioned precisely such as by lead screw 24 in the manner illustrated.

In order to initiate the formation of a groove in a tube by twisting it, it is necessary to form a point in the wall of the tube having reduced resistance to torsional force. This is typically done by indenting or dimpling the tube at the point where the groove is to be initiated. Only one such dimple may be placed in the tube wall if a single spiral is to be imparted in the tube. The usual procedure, however, is to form two or three dimples in the tube wall to cause the simultaneous formmation of a plurality of paralleled grooves, each having the same lead. The formation of a dimple or point of reduced torsional resistance is not illustrated herein since this step is well illustrated in the previously referenced prior art and is described in detail in Pat. 3,015,355.

The heating element positioning gear 36 is affixed to a heating element lead screw 40. Received on the heating element lead screw 40 is an internally theaded heating element follower 42 having an arm 44 extending therefrom which supports a tube heating element 46.

Figure 2:
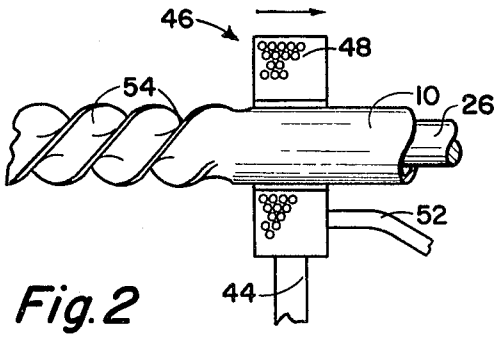
FIG. 2 is an enlarged fragmentary view showing heating coil positioned around a tube and showing the tube having the helical grooves formed in one portion thereof llustrative of the manner wherein inductive heating may be applied to the tube in the area and immediately in advance of the area wherein the spiral groove or grooves is being formed in the tube.

The heating element 46 may take on different forms, all accomplishing the same purpose. The preferred arrangement, as illustrated in FIGS. 1 and 2, employs the use of an inductive heating means. Inductive heating is accomplished by means of a coil 48 supplied by a source of high frequency A.C. energy indicated by transformer 50 connected to an A.C. source of the selected frequency. By means of flexible conductors 52 the conductive heating element 56 subjects the tube 10 to high frequency electromagnetic action. This induces heat in the tube so that the temperature of the tube at the area wherein spiral or grooves 54 are being formed can be raised to a desired level to increase the ductility of the material of which the tube 10 is formed. As has been previously stated some material, such as aluminum, copper and so forth, are sufficiently ductile at ambient temperature and no heating and is required to impart a spiral groove in the tube by twisting it. However, some materials, preferably when thicker walls are employed, are not sufficiently ductile at ambient temperatures to allow the progressive twisting of a spiral. By the application of heat such as by means of the inductive heating element 48, the temperature of the tube at the point where the spiral is being formed can be raised to increase the ductility to the desired level.

Inductive heating element 48 is preferably moved slightly ahead of the point of formation of the spiral or spirals 54 as they are formed as the tube is twisted. For this purpose, lead screw 40 and follower 42 are arranged to move along the length of tube 10 at the rate of formation of the spiral. The spiraled groove or grooves 54 and tube 10 can be formed either in a direction from adjacent the headstock 16 towards the tailstock 20 or in the opposite direction, and it can be seen that the mechanism for moving the heating element 46 can be easily arranged to accommodate either mode.

Figure 3:
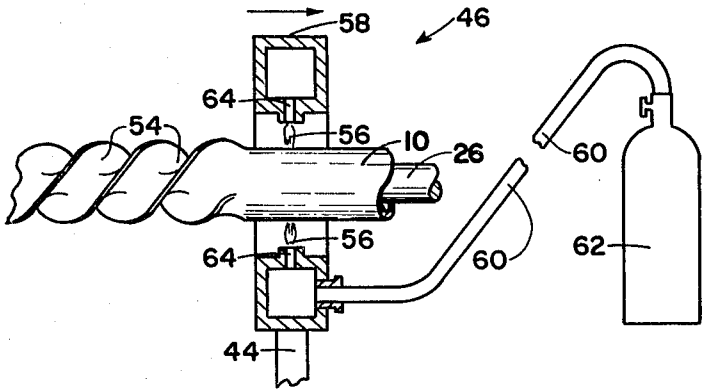
FIG. 3 is a fragmentary cross-sectional view as in FIG. 2 but showing the use of a gas burner for applying heat to the tube.

Another arrangement of a heating element is shown in FIG. 3. In this embodiment the tube heating element 46 is in the form of a device utilizing a flame. A burner directs one or more, and preferably a plurality, of flames 56 against or adjacent the surface of tube 10. In the illustrated arrangement a circumferential chamber 58, which is hollow or has a gas passageway inside it, is connected by means of a flexible hose 60 to a source of fuel, such as a pressurized tank 62. Positioned interiorly of the chamber 58 are a plurality of jets 64, each of which directs a flame 56 towards the surface of tube 10. The housing 58 supporting the jets is moved along in advance of the formation of the spiral the same as is the inductive coil 48.

Another means of practicing the invention is that of heating the entire tube 10 to the desired temperature before the initiation of a spiral in it. This can be accomplished by heating it in a furnace before it is placed in the machine for forming the spiral or by heating it after it is placed in the machine and ready for the formation of a spiral groove therein. In either arrangement the objective is to increase the temperature of the tube above ambient and below the melting point to the desired range of temperature to increase the yieldability of the material as necessary for the formation of a spiral as the tube is twisted. The exact temperature necessary for the formation of spiral grooves in tubing depends upon many factors, including primarily the material of which the tube is formed. Even in a selected material, many hardnesses are available according to heat treatment and alloy content. Other factors affecting the desired temperature for the formation of spiral grooves includes the diameter of the tube, the tube thickness, the rate at which the spiral or spirals are being imparted in the tube and so forth. While the temperature required for a certain tube is virtually impossible to state in advance, nevertheless, those skilled in the art of manufacturing spiraled tubing can easily and expeditiously determine in a relatively short time the desired temperature of the tube in the area wherein the spiral groove is to be formed and thereby determine the amount of heat which must be applied for the manufacturing process.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. A method of manufacturing a spiraled tube comprising:

(a) positioning an elongated cylindrical mandrel within a tube;

(b) grasping the tube adjacent the first end with a motor driven headstock;

(c) grasping the tube adjacent the second end with a non rotating tailstock;

(d) forming at least one point of reduced resistance to torsional force on the wall of the tube, which step may be accomplished before or after steps (a) and (b);

(e) rotating the headstock by means of said headstock motor to initiate and extend the formation of at least one spiral groove in the tube, the mandrel defining the minimum interior diameter of the spiraled tube so formed;

(f) driving a first and a second lead screw by means of said headstock drive motor;

(g) advancing said tailstock towards said head stock by coupling said first lead screw to said tail stock to compensate for the reduction in length of the tube as the spiral groove is formed;

(h) supporting a heating element adjacent the tube;

(i) advancing said heating element towards said headstock by means of said second lead screw whereby said heating element is positioned adjacent the area of the tube wherein spiral groove is formed as the tube is rotated to raise the area of formation of the spiral groove to a temperature above ambient and below the melting point of the tube material.

2. A method of manufacturing a spiraled tube according to claim 1 wherein said heating means is in the form of electroinductive means.

3. A method of manufacturing a spiraled tube according to claim 1 wherein said heating means is in the form of gas flame means.

* * * * *

UNITED STATES PATENT AND TRADEMARK OFFICE

CERTIFICATE OF CORRECTION

PATENT NO. : 4,437,329

DATED : March 20, 1984

INVENTOR(S) : ELMO W. GEPPELT; WILLIAM H. POORE, both of Tulsa, Oklahoma

It is certified that error appears in the above-identified patent and that said Letters Patent is hereby corrected as shown below:

Column 3, line 45, change "formmation" to --formation--.

Signed and Sealed this

*Twenty-sixth* Day of *February 1985*

[SEAL]

*Attest:*

DONALD J. QUIGG

*Attesting Officer* *Acting Commissioner of Patents and Trademarks*